US011506349B2

(12) United States Patent
Porciatti et al.

(10) Patent No.: US 11,506,349 B2
(45) Date of Patent: Nov. 22, 2022

(54) SUSPENDED CEILING LIGHT WITH INTEGRATED CROSS-TEES

(71) Applicant: JLC-Tech IP, LLC, Weston, FL (US)

(72) Inventors: Silvio Porciatti, Pembroke, MA (US); Jeffrey Corvese, Marshfield, MA (US)

(73) Assignee: JLC-Tech IP, LLC, Weston, FL (US)

( * ) Notice: Subject to any disclaimer, the term of this patent is extended or adjusted under 35 U.S.C. 154(b) by 0 days.

(21) Appl. No.: 17/313,413

(22) Filed: May 6, 2021

(65) Prior Publication Data

US 2021/0348730 A1 Nov. 11, 2021

Related U.S. Application Data

(60) Provisional application No. 63/021,771, filed on May 8, 2020.

(51) Int. Cl.

| | |
|---|---|
| ***F21S 8/06*** | (2006.01) |
| ***E04B 9/00*** | (2006.01) |
| ***E04B 9/18*** | (2006.01) |
| ***E04B 9/06*** | (2006.01) |
| ***F21S 4/28*** | (2016.01) |
| ***F21V 21/04*** | (2006.01) |
| ***F21Y 115/10*** | (2016.01) |
| ***F21V 29/70*** | (2015.01) |
| ***E04B 9/12*** | (2006.01) |

(52) U.S. Cl.

CPC ..... *F21S 8/06* (2013.01); *E04B 9/006* (2013.01); *E04B 9/067* (2013.01); *E04B 9/18* (2013.01); *F21S 4/28* (2016.01); *F21V 21/048* (2013.01); *E04B 9/127* (2013.01); *F21V 29/70* (2015.01); *F21Y 2115/10* (2016.08)

(58) Field of Classification Search

CPC ... F21S 8/026; F21S 8/043; F21S 8/06; E04B 9/006; E04B 9/067; E04B 9/18; F21V 29/70

See application file for complete search history.

(56) References Cited

U.S. PATENT DOCUMENTS

| | | | | |
|---|---|---|---|---|
| 9,879,850 | B2 | 1/2018 | Porciatti | |
| D834,238 | S | 11/2018 | Porciatti | |
| D834,239 | S | 11/2018 | Porciatti | |
| 10,145,536 | B1 | 12/2018 | Porciatti | |
| 10,222,049 | B2 | 3/2019 | Porciatti | |
| 2017/0082252 | A1* | 3/2017 | Casement | G02B 6/0046 |
| 2017/0307191 | A1* | 10/2017 | Neal | F21V 21/049 |
| 2017/0336058 | A1* | 11/2017 | Jones | F21V 21/044 |

* cited by examiner

*Primary Examiner* — Alan B Cariaso

(74) *Attorney, Agent, or Firm* — Heisler & Associates

(57) ABSTRACT

In a suspended ceiling a housing is provided including a light located within an interior chamber having a lower opening. The housing includes lateral sides with slots therein which can receive fasteners coupled to ends of other T-bars. Ends of the housing can include fasteners, such as tabs or clips, which attach ends of the housing to adjacent supports, such as other T-bars within the suspended ceiling. In one embodiment, the housing has a constant cross-sectional form. The cross-sectional form can include lateral sides defined by lateral cross-tees with a vertical spine and lateral rest shelf upon which an edge of the ceiling tile can be supported. A central cross-tee can optionally be provided extending down from upper portions of the housing and between diagonal spans on upper lateral portions of the housing. One or more diffusers span the lower opening of the housing.

16 Claims, 7 Drawing Sheets

SUSPENDED CEILING LIGHT WITH INTEGRATED CROSS-TEES

CROSS-REFERENCE TO RELATED APPLICATIONS

This application claims benefit under Title 35, United States Code § 119(e) of U.S. Provisional Application No. 63/021,771 filed on May 8, 2020.

FIELD OF THE INVENTION

The following invention relates to indoor ceiling lighting for integration into a grid ceiling. More particularly, this invention relates to lighting which replaces a T-bar and also functions structurally as a T-bar while also providing lighting.

BACKGROUND OF THE INVENTION

Lighting for indoor spaces is often provided in a manner suspended from the ceiling. Such light positioning avoids using up floor space and minimizes shadowing, and also provides ample lighting for the reading of documents and other items which are generally facing upward with the light from the ceiling lighting shining thereon. Often ceilings in business and commercial work spaces are suspended from upper portions of a space. One common way to provide a suspended ceiling is to provide a grid of elongate T-bars (also referred to as "cross-tees"). These T-bars have a cross-section in the form of an inverted "T," including a vertically oriented spine and a horizontally oriented shelf which extends horizontally in either direction from a lower portion of the spine. Ceiling tiles are provided within the spaces between the T-bars and within the grid. Edges of the ceiling tiles rest upon the shelves of the T-bars.

Ends of the T-bars are either attached to mid-portions of other T-bars or are attached to a wall, at least indirectly, if they are at an edge of the ceiling. The T-bars are typically not sufficiently strong to span open spaces within the room without sagging. Thus, various mid-portions of this grid formed by the T-bars have suspension wires or other suspension elements coupled thereto and then connected to elevated portions of the space, so that the overall grid, as well as the weight of the ceiling tiles is adequately supported.

A common prior art way to provide lighting within such a suspended ceiling is to take a space which would ordinarily contain a ceiling tile, and instead fit a lighting module within that space. This results in lighting elements which are generally square or rectangular in shape, matching the shape of the spaces within the grid. While generally effective, such a simple arrangement has a variety of drawbacks. First, ceilings end up with an appearance which is dominated by spaces within the grid which are taken up by lighting elements or other elements (such as HVAC air distribution registers, and other equipment). The ceiling then takes on more of a functional role, rather than an aesthetic role, with appearance attributes of the ceiling not being optimized.

Workers within commercial and industrial spaces can experience fatigue due to the nature of the work being performed. Employers desire to have satisfied employees who enjoy their work environment. Thus, it is not a trivial matter to provide as desirable a workspace as possible. While designers can provide a variety of aesthetically pleasing ceiling tiles and T-bar grid arrangements, these efforts are to some extent undermined by the large number of spaces within the grid which are filled with square and rectangular prior art lighting elements.

It is known to provide lighting within the shelf at the lower portion of a T-bar element, within the grid of the suspended ceiling. Examples of such lighting integrated into T-bars include those disclosed in U.S. Pat. Nos. 8,177,385; 10,145,536; 10,222,049; 10,309,638; and 10,317,042. When lighting is integrated into the T-bars themselves, this leaves the spaces between the T-bars free to provide a more aesthetically pleasing appearance, and gives the designer more opportunities to provide an aesthetically pleasing appearance for the ceiling. Typically, when lighting is provided within an underside of a T-bar, the lighting is more for accents, rather than to provide the main lighting for the space. This is because the surface area provided by the under surface of the T-bars is relatively small. If the lights are intense enough to light the entire space with the desired amount of light, and this lighting is concentrated within the under surfaces of the T-bars, the lighting can be too bright for the health and/or enjoyment of workers and others who may occasionally inadvertently gaze directly up at the lights or view excessively intense light reflected off of surfaces beneath such lights. Furthermore, the concentrated lighting can create a significant concentration of heat which can be difficult to manage.

Accordingly, a need exists for ceiling lighting which can be integrated into a suspended ceiling without taking up entire spaces within a grid formed by the T-bars, but which is larger in surface area then just the underside of the T-bars themselves. Such lighting also would need to easily integrate into adjacent T-bars within the grid and provide the grid with requisite rigidity for supporting adjacent ceiling tiles, without necessarily requiring additional vertical suspension wires and other elements adjacent to the lighting to provide adequate support for gravity loads associated with the ceiling.

SUMMARY OF THE INVENTION

With this invention, a lighting element for a suspended ceiling is provided which integrates into adjacent T-bars in all of the different ways required to allow for the T-bar grid of the suspended ceiling to be maintained. The lighting element replaces a T-bar segment between adjacent T-bars, providing both lighting functionality and providing the structural support functionality which was provided by the T-bar that the lighting element replaces. The structural support provided includes structural support to hold up the lighting element itself, structural support added to the grid, so that overall grid strength is maintained, and structural support for adjacent ceiling tiles resting upon portions of the lighting element of this invention. Furthermore, the lighting element has a greater width than just a width of the T-bar itself. For instance, the lighting elements can be 4 inches wide in one embodiment (or greater, such as 6 inches wide).

The lighting element preferably has a substantially constant cross-sectional form which is generally elongate between two ends. These ends are spaced apart by a distance spanned by T-bars within the grid of the suspended ceiling where the lighting element is to be utilized. For instance, if the ceiling has parallel T-bars spaced two feet from each other in two separate perpendicular directions, so that the spaces filled by ceiling tiles are approximately 2'×2', then the lighting element could be approximately two feet long. In a common and typical embodiment, the lighting element would be double the length of the individual spaces within the grid ceiling, so that in the above example, the lighting element would be four feet long. In other embodiments, the lighting element can be provided two, four, five, six or eight feet long to match current common suspended ceiling systems (or other lengths).

The constant cross-sectional form can be provided by extrusion, such as from aluminum. Such a basic extruded structure can provide structural support for the lighting element. In addition, the lighting element would include lighting electronics, such as elongate LED modules, light diffusing structures for appropriately diffusing the light produced by the lighting electronics, and associated wiring for providing power and control signals to the lighting electronics associated with the lighting element. The lighting element can also include end caps which close off ends of the structure and enclose the lighting electronics.

In particular, in one embodiment described by way of example, the extruded structure or other structure associated with the lighting element includes within the singular extruded contour two lateral cross-tees and a channel for holding a central cross-tee (or the central cross-tee could be part of a single extrusion without the lateral cross-tees). The central cross-tee and the two lateral cross-tees are each parallel with each other and each generally include some form of planar spine (or plate) extending substantially vertically up from lower portions of the cross-tees, which are generally in the plane of the underside of the suspended ceiling. Each of these cross-tees also preferably include at least some form of shelf at a lower portion thereof. For the central cross-tee, these shelves can support edges of a planar diffuser spanning open lower portions of the lighting element through which light shines down into the space beneath the ceiling where the lighting element is installed. For the two lateral cross-tees, shelves extend laterally away from a central vertical elongate plane (in which the central cross-tee is located), to support edges of ceiling tiles which are adjacent to the lighting element.

The cross-tees are joined together by diagonal spans which extend from an inboard side of each of the lateral cross-tees upwardly and inwardly to an upper portion of the housing. These diagonal spans are preferably substantially planar in form. The lateral cross-tees also include a downwardly extending diffuser support foot which extends downwardly and then inwardly to define an inwardly facing gap which faces the central cross-tee and can support an outer edge of a diffuser, while an inner edge of the diffuser is supported by the shelf at the lower portion of the central cross-tee.

Beneath the diagonal spans and adjacent to the central cross-tee, a flange is provided which extends somewhat downwardly away from the diagonal spans, with faces of these flanges generally facing a center of each of the openings provided lateral to opposing sides of the cross-tee and beneath the diagonal spans. Two openings are provided, one on either side of the central cross-tee. Each of the flanges can support lighting electronics on the surface thereof, so that light shining from the lighting electronics faces downwardly at the openings. These openings are typically each spanned by diffusers. The lighting electronics are preferably in the form of high intensity LED lights, which are provided at appropriate spacing extending from each of the ends of the lighting element. The flanges also add rigidity and strength to the overall assembly.

An upper portion of the extruded structure housing, above the central cross-tee, preferably extend up above the diagonal spans and can include heat transfer fins thereon, as well as holes for supporting mounting screws for mounting an end cap, and also can support suspension elements which extend up from the lighting element to assist in supporting the lighting element and adjacent portions of the grid beneath upper portions of the space where the grid ceiling is mounted. Other screw mounting holes for mounting end caps can be formed into the extrusion at midpoints of the diagonal spans. Because aluminum is easily extruded, and relatively soft metal, and not particularly galvanically active, a variety of different kinds of screws formed of harder metal materials can self tap into such holes (or C channels which provide a large portion of a hole), such as to hold an end cap on to an end of the lighting element, or for attachment of other structures to an end of the lighting element.

The central cross-tee most preferably is a separate extrusion from other portions of the extruded structure making up the structure for the lighting element. This central cross-tee fits tightly into a central underside channel in the extruded structure including the lateral cross-tees. A screw vertically from above can engage the central cross-tee and fasten it to the other extruded structures (or it can be held by friction, welding, adhesive, etc.). The central cross-tee can come in at least two forms. In one form the central cross-tee has a lower shelf to support inner edges of two diffusers at a lower surface of the lighting element. In another form the spine of the central cross-tee has no shelf (and can be a little shorter or eliminated altogether) and a single diffuser spans the entire space between lower portions of the two lateral cross-tees. Such a single diffuser can be larger than the two diffusers combined, to provide more light surface. Such an embodiment could be served by a single LED module or more than two LED modules or other light sources. In both forms, a standard 22"×24" ceiling tile can be used adjacent to the lighting element, so that custom ceiling tile cutting can be minimized or eliminated.

The spines on the two lateral cross-tees add rigidity to the lighting element. Furthermore, in embodiments where the lighting element is longer than spaces between T-bars in the grid ceiling, intermediate slots can be supplied within these spines, which can carry clips or other fasteners at ends of other T-bars, so that these other T-bars can connect to these spines and help to integrate and rigidify the overall grid ceiling which incorporates the lighting element. If the lighting element is twice the length of spaces between adjacent T-bars, one such slot would be provided within each of these fins at a midpoint of each spine. If the lighting element is longer than double this short spacing between adjacent T-bars (or some other length), a larger number of slots would be provided, typically at regular (e.g. two foot) intervals, and where desired for attachment of ends of adjacent perpendicular T-bars, for connection to the lighting element through the spines of the lateral cross-tees.

The ends of the lighting element can be attached to mid-portions of other T-bars, such as by utilizing an appropriate clip or other fastener connected to the central cross-tee at an end (or both ends) thereof, and then passing into a slot within a spine of a T-bar to which the lighting element is mounted (or hanging over a spine with clips). These clips and other fasteners for connecting the lighting element into the grid ceiling can be similar clips and/or fasteners as those used in other grid ceiling and suspended ceiling systems, and can include appropriate adapters as necessary to allow the lighting element to be compatible with a variety of different known suspended ceiling systems. End caps are shown which accommodate these clips or other fasteners. For lighting elements with no central cross-tee, fasteners can extend from at least one (and typically both) of the lateral cross-tees, with the end caps accommodating placement of such fasteners. Such end caps also preferably have a clear (or other decorative) lower cover portion, which can be exposed slightly below the shelves of the T-bars in some embodiments. A horizontal flange is provided extending from a lower portion of the end caps, and just above any "lower portion," such as that mentioned above. The flange rests upon a rest shelf of a T-bar adjacent to the end of the lighting element, keeping it supported and aligned vertically within the grid ceiling.

OBJECTS OF THE INVENTION

Accordingly, a primary object of the present invention is to provide a light integrated into a suspended ceiling without the light taking up a large amount of ceiling surface area.

Another object of the present invention is to provide a light within a suspended ceiling which has more surface area than that of a lower surface of a T-bar, but less than a surface area of a ceiling tile between T-bars in the suspended ceiling.

Another object of the present invention is to provide a light within a suspended ceiling which includes a housing which is attachable to other T-bars within the suspended ceiling.

Another object of the present invention is to provide a light within a suspended ceiling which attaches to other elements of the suspended ceiling in a manner similar to the way that T-bars and ceiling tiles within the suspended ceiling are already configured to attach, for ease of integration of the light into the suspended ceiling.

Another object of the present invention is to provide a light for a suspended ceiling which replaces at least a portion of a T-bar within the suspended ceiling while maintaining function of the T-bar, including attachability to other T-bars, support for ceiling tiles, and assistance in maintain planar rigidity of the suspended ceiling.

Another object of the present invention is to provide a light for a suspended ceiling which has a unique and desirable aesthetic appearance, and which can facilitate a variety of interesting and functional ceiling lighting configurations.

Another object of the present invention is to provide a light for a suspended ceiling which is easy to install using mostly existing fasteners.

Another object of the present invention is to provide a light for a suspended ceiling which accommodates heat transfer away from LED lighting modules sufficient to maintain optimal performance for the lighting modules and minimizing heat transfer into air-conditioned space beneath the light.

Another object of the present invention is to provide a light for a suspended ceiling which has high rigidity and resistance to bending loads, such as bending loads associated with weight of the light itself and weight of T-bars and ceiling tiles to some extent carried by the light.

Other further objects of the present invention will become apparent from a careful reading of the included drawing figures, the claims and detailed description of the invention.

DESCRIPTION OF THE PREFERRED EMBODIMENT

Figure 1:
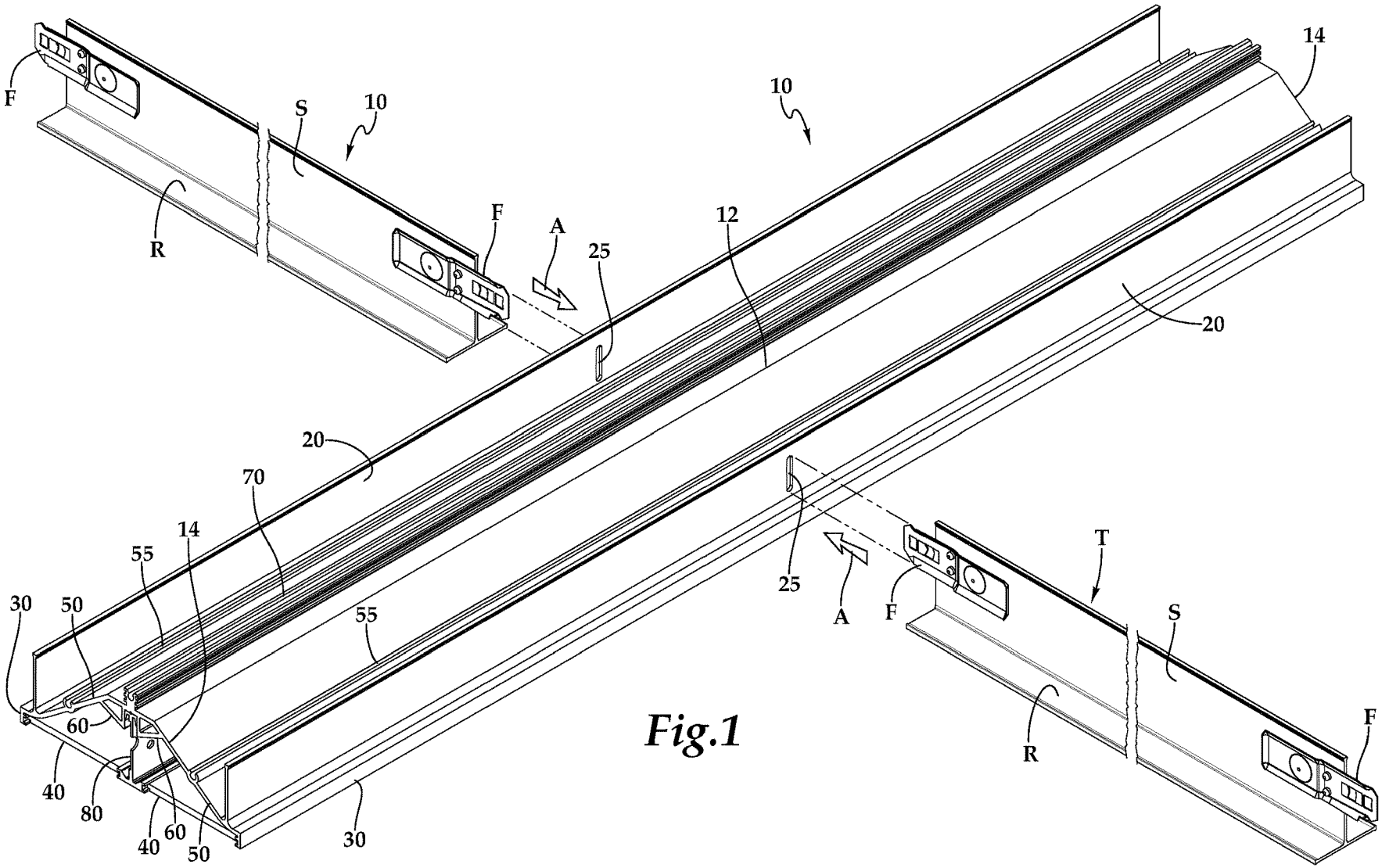
FIG. 1 is a perspective view of the light element of this invention according to one embodiment and with two T-bars exploded away from lateral sides of the lighting element, illustrating how lateral T-bars can attach to the lighting element within a suspended ceiling.
Figure 2:
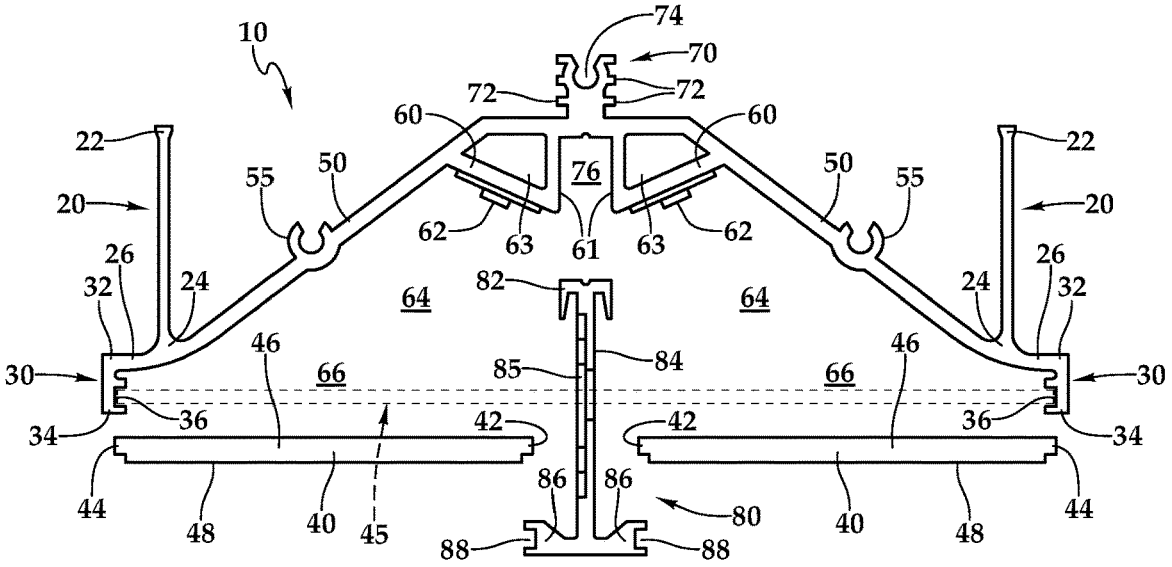
FIG. 2 is an end elevation full sectional view of that which is shown in FIG. 1, and with an optional central cross-tee shown exploded away from a housing, primarily provided as an extrusion with a constant cross-section in this embodiment, and also illustrating in broken lines an optional large diffuser spanning a lower opening of a chamber of the housing.
Figure 3:
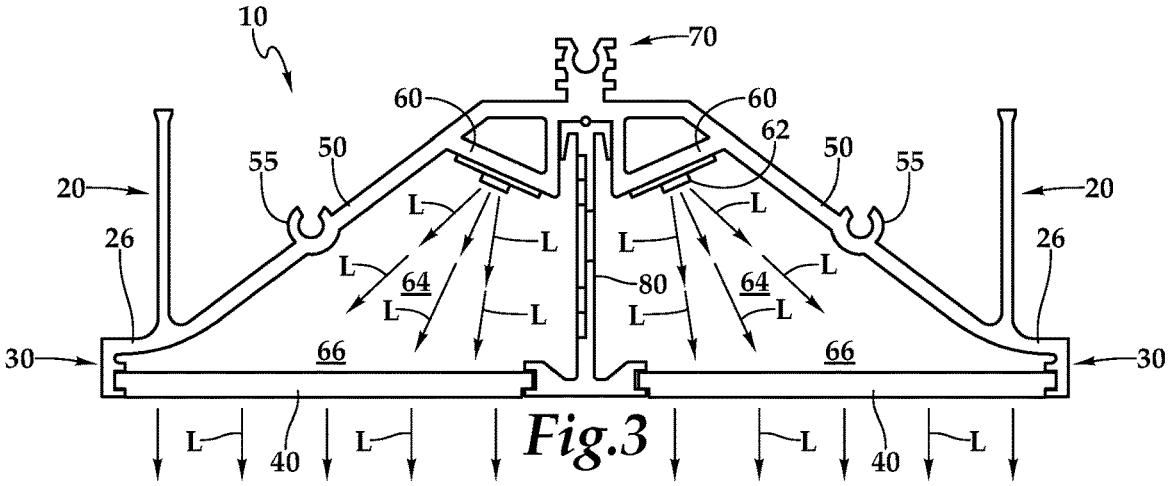
FIG. 3 is an end elevation full sectional view similar to that which is shown in FIG. 2, but with the central cross-tee installed and with two diffusers in position diffusing light passing from LED modules and down from the lighting element.
Figure 4:
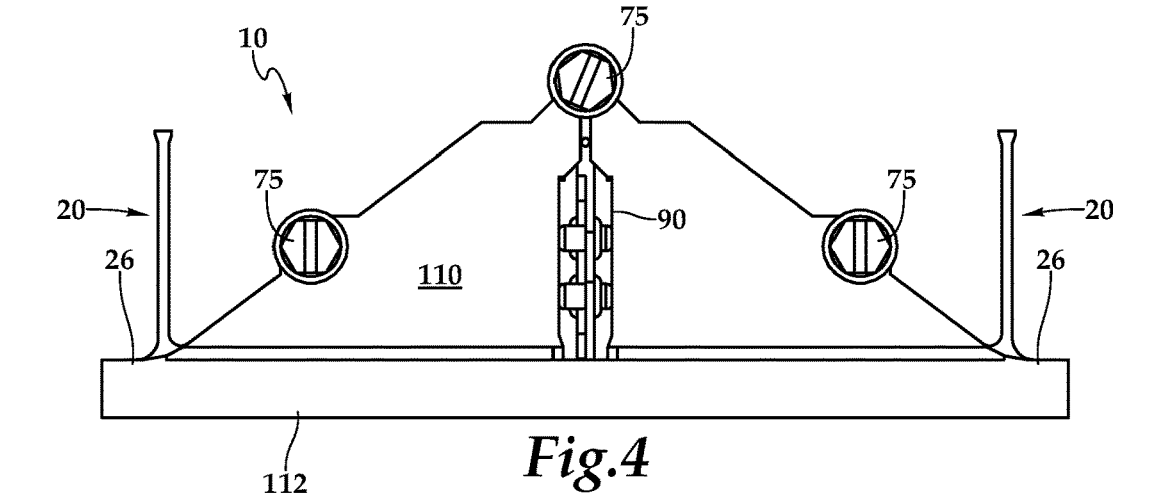
FIG. 4 is an end elevation view of the lighting element of FIG. 1 and showing how an end cap and end cover can fit over ends of the lighting element to close off ends of a chamber of the housing of the lighting element.
Figure 5:
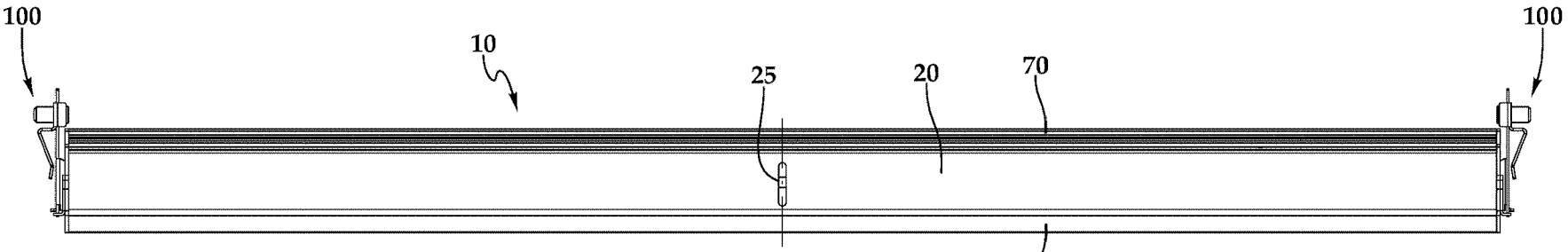
FIG. 5 is a lateral side elevation view of that which is shown in FIG. 1, and further including clips as one form of fastener at ends of the lighting element.

Referring to the drawings, wherein like reference numerals represent like parts throughout the various drawing figures, reference numeral 10 is directed to a lighting element (FIG. 1) integrated into a suspended ceiling including T-bars T and ceiling tiles C (FIGS. 9 and 10) and which can provide an elongate form having a width of a size slightly larger than a lower surface of a T-bar, but leaving most of the ceiling tiles C unmodified or only partially modified, and still providing a large amount of light from the lighting element 10.

In essence, and with particular reference to FIGS. 1-4, basic details of the lighting element 10 are described, according to this one example embodiment. The lighting element 10 is primarily formed of a housing formed in this embodiment as an extrusion 12 extending linearly between ends 14 and having two lateral sides defining a length of the extrusion 12 between the ends 14. The contour of the housing includes lateral cross-tees 20 near lateral edges of the housing which support slots 25 to which T-bars T or other elements of the suspended ceiling can be connected. A rest shelf 26 is also included with each lateral cross-tee 20 which can carry an edge of a ceiling tile C (FIGS. 9 and 10) within the suspended ceiling adjacent to the lighting element 10. A support foot 30 extends down from lateral sides of the housing, which support foot 30 supports edges of diffusers 40 (or a single large diffuser 45, such as that shown in FIG. 2) spanning a lower portion of the housing.

A diagonal span 50 extends from lower portions of each of the lateral cross-tees 20, up to an upper portion 70 where the two diagonal spans 50 come together. Flanges 60 extend from the diagonal spans 50 within an interior of the housing, which flanges 60 support an LED module 62 therein which acts as a preferred form of light source for the lighting element 10. A central cross-tee 80 can optionally be provided either as part of the extrusion 12 or as a separate element attachable to the extrusion 12 and within the housing. The central cross-tee 80 can add rigidity to the lighting element 10 and also carry inner edges 42 of diffusers 40 on either side of the central cross-tee 80 which is oriented within a central elongate vertical plane midway between the lateral cross-tees 20. Ends of the central cross-tees can also carrier fasteners such as a tab 90. A clip 100 provides an alternate form of fastener for an end of the lighting element 10, which tab 90 or clip 100 act as fasteners for carrying ends 14 of the lighting element 10 relative to other portions of the suspended ceiling.

More specifically, and with continuing reference to FIGS. 1-4, particular details of various portions of the housing and other parts of the lighting element 10 are described, according to this example embodiment depicted in the included figures. The lighting element 10 is primarily provided structurally by an extrusion 12 defining most or all of a housing from which light emanates. This extrusion 12 has a constant cross-sectional form extending between ends 14 in this example embodiment. The ends are preferably parallel to each other and define a length of the housing. The extrusion 12 is generally a concave structure with a lower opening 66 of an interior chamber 64 facing downward and allowing light L from an LED module 62 (or pair of LED modules 62 or other light source) to emanate downwardly as light L to provide illumination for a space beneath a suspended ceiling incorporating the lighting element 10 therein.

Figure 6:
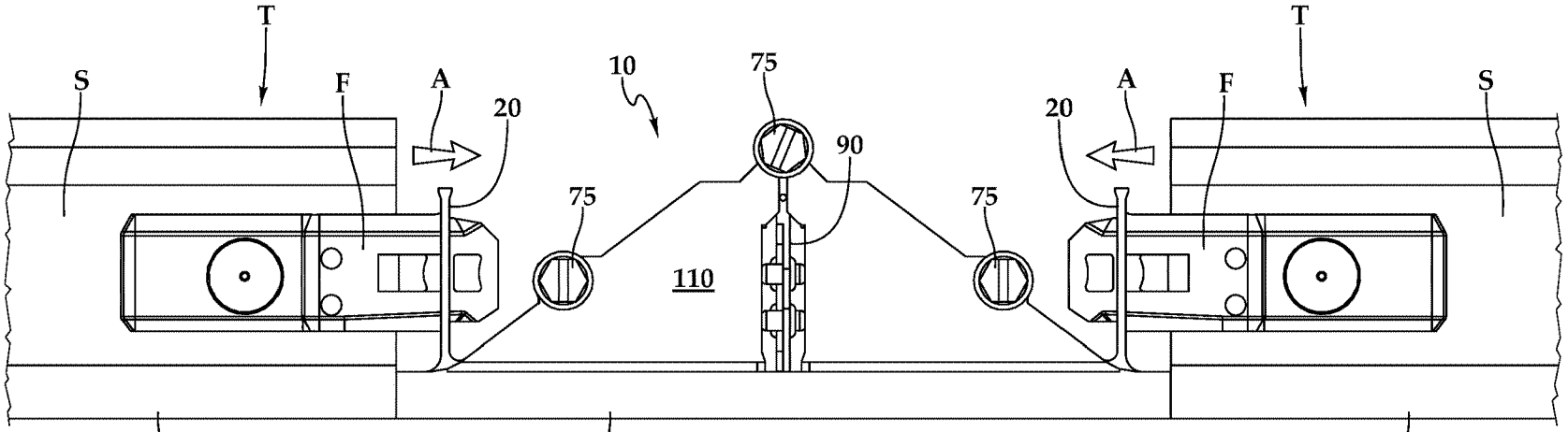
FIG. 6 is an end elevation view of that which is shown in FIG. 1, and with adjacent T-bars shown attached to the lighting element and with an end cover also located upon the lighting element.
Figure 7:
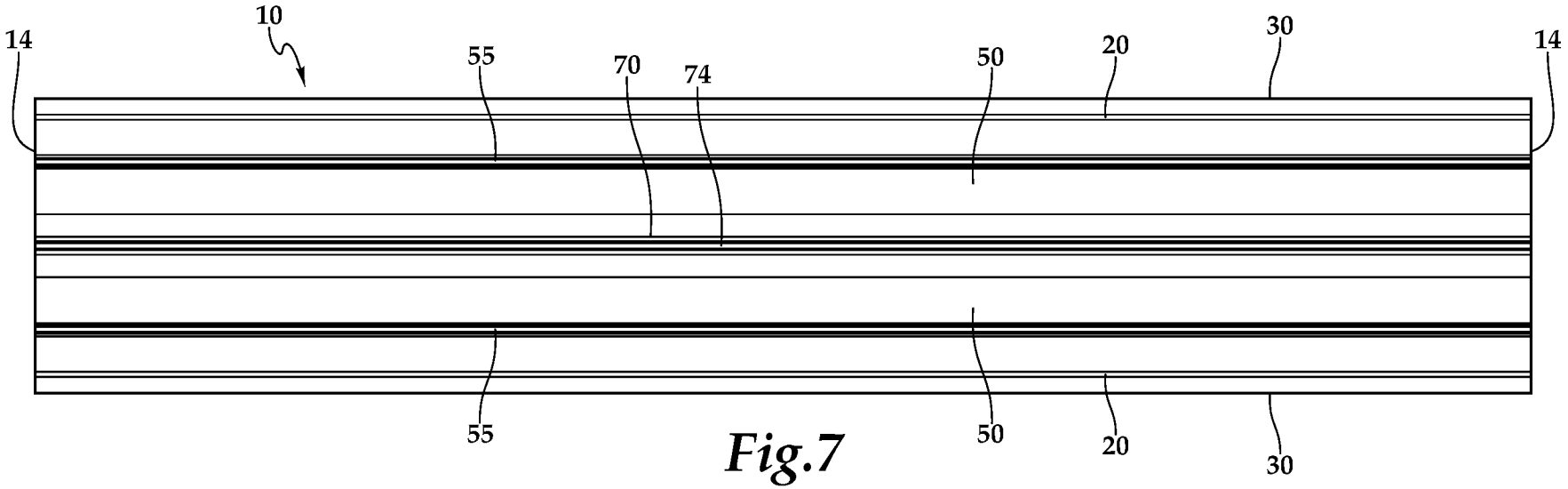
FIG. 7 is a top plan view of that which is shown in FIG. 5.
Figure 8:
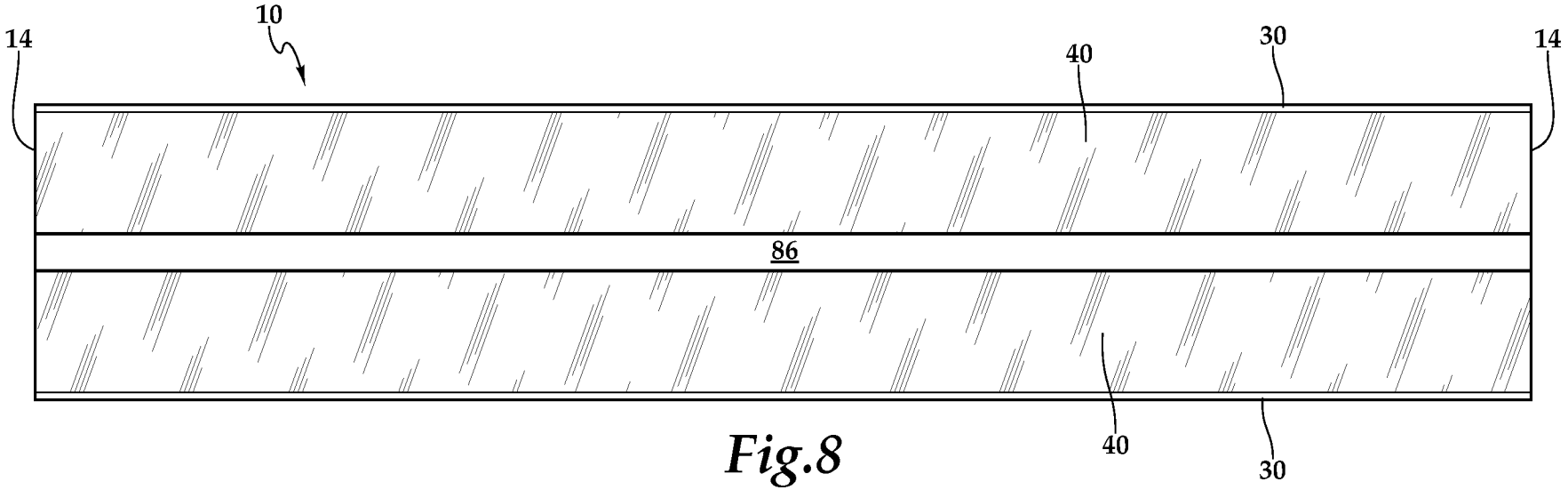
FIG. 8 is a bottom plan view of that which is shown in FIG. 5.

The extrusion 12 includes lateral cross-tees 20 near lateral edges of the extrusion 12. Each lateral cross-tee 20 includes a spine extending from a tip 22 at an uppermost portion of the spine to a root 24 at a lowermost portion of the spine, and where the spine of each lateral cross-tee 20 joins with other portions of the extrusion 12. The spine preferably includes at least one slot 25 therein, preferably located at a midpoint in the lateral cross-tee 20. This slot 25 is sized and shaped to receive a fastener F, such as a tab at an end of an adjacent T-bar T, so that the lateral cross-tees 20 can integrate into and carry adjacent portions of a suspended ceiling (see FIGS. 1 and 6).

The lateral cross-tees 20 also include a shelf 26 extending away from a centerline of the extrusion. Each shelf 28 is generally complimentary in form to a ceiling tile of a typical T-bar T, so that the ceiling tiles C (FIGS. 9 and 10) can have an edge thereof resting upon the shelf 28 to allow a lateral portion of a ceiling tile C to be carried by portions of the lighting element 10.

A support foot 30 extends down from each lateral cross-tee 20 and defines a lowermost (and most lateral) portion of the extrusion 12 of the lighting element 10. Each support foot 30 has a top 32 general connected to an underside of the shelf 26, and extending down to a tip 34 at a lowermost portion of the support foot 30. Inside portions of the support foot 30 include an inwardly facing gap 36. The gap 36 is sized to receive and outer edge 44 of a diffuser 40.

A pair of diffusers 40 are provided in this example embodiment which are translucent in character, allowing light L to be transmitted therethrough in a diffuse manner and to illuminate objects within a room beneath the suspended ceiling. In one embodiment, a pair of diffusers 40 are replaced with a single large diffuser 45 extending all of the way between inwardly facing gaps 36 in each support foot 30 of the extrusion 12 (see FIGS. 2 and 10). However, as shown in other figures where a central cross-tee 80 is provided (either as part of the extrusion 12 or as a separate structure attachable to the extrusion 12), inner edges 42 of the pair of smaller diffusers 40 are carried by the central cross-tee 80.

The diffusers 40 include an upper surface 46 opposite a lower surface 48. The upper surface 46 faces the chamber 64 and the lower surface 48 is visible when viewing the lighting element 10 from below. By providing a diffuser, high intensity LED lights have their intensity averaged out and diffused over the surfaces of the diffusers to provide a larger surface area of lesser intensity light, rather than highly focused very bright lights, which might be damaging or less pleasing for individuals and/or equipment located in a space beneath the suspended ceiling including the lighting element 10. Surfaces of the chamber 64 above the diffusers 40 can be reflective in nature, either by including a reflective layer/coating, or merely being formed of a material having reflective properties, such as extruded aluminum, so that light from LED modules 62 which is initially directed in an unproductive direction other than downwardly, will reflect about within the chamber 64 with most intensity maintained, until the light L strikes the diffuser 40 and is then transmitted through the diffuser 40 to provide productive light L into a space beneath the lighting element 10. In this way, a large proportion of light emanating from the LED modules 62 ends up as productive light illuminating space beneath the suspended ceiling including the lighting element 10 therein.

A pair of diagonal spans 50 extend from the lateral cross-tees 20 to an upper portion 70 of the extrusion 12 defining an upper portion of the housing. The diagonal spans 50 are preferably thin elongate portions of the extrusion 12 which are generally planar in form. A lower end 52 of each diagonal span 50 is adjacent to the root 24 of each lateral cross-tee 20. Upper ends 54 of the diagonal spans 50 are adjacent to the upper portion 70. A screw support slot 55 (or a hole) can be provided within the diagonal span 50, such as near a midpoint, which is sized to receive a threaded shaft of a screw therein, such that an end cap 110 or other structures can be readily attached to the housing through the screw support slot 55 in the diagonal span 50.

In this embodiment, the screw support slot 55 is integrated into the extrusion 12 for simplicity. However, such a screw support slot 55 (or hole) could be provided as a separate structure attachable to the diagonal span 50 or other portions of the extrusion 12, or could be formed into the diagonal span 50 or other portions of the extrusion 12 in a second milling and/or tapping step. The upper end 54 of the diagonal span 50 preferably ends with an upper flat so that central portions of the extrusion 12 adjacent to the upper portion 70 have a flat surface oriented within a horizontal plane near central portions of the housing.

Within the housing and beneath the diagonal span 50 and upper portion 70, a flange 60 is provided. This flange 60 is provided in pairs, with one beneath each of the diagonal spans 50. The flanges 60 extend downwardly and inwardly away from the diagonal spans 50 and toward a central vertical channel 76, to provide an elongate plane for support of a light source therein. The flanges 60 have a lower surface facing the diffusers 40 and upon which an elongated LED module 62 is mounted, in this embodiment. The LED module 62 is elongate in form and includes separate individual LEDs, such as high intensity LEDs, at periodic locations (such as one every inch) along the elongate LED module.

In a typical embodiment, the LED module 62 is in the form of a printed circuit board with the LEDs themselves surface mounted on the printed circuit board. The board provides appropriate electronics to support the LEDs themselves and to cause the LEDs to emit light in accordance with their design. Electric power to the LED modules is typically provided from above, by forming holes passing through the upper portion 70 or diagonal span 50 and through the flange 60. However, wiring could be provided in a variety of different orientations, such as through the ends 14.

Arms 61 hold inside edges of the flange 60 and extend up to the upper portion 70 and the upper flat 56 of each diagonal span 50. These arms 61 are spaced apart so that a channel 76 is located therebetween. The arms 61 are preferably oriented within vertical planes. Space 63 is provided above the flanges 60 which is generally enclosed. In one embodiment, the space 63 could be configured to be open at the ends 14 (or through other ports) to facilitate natural convection heat transfer for removal of heat away from the LED modules 62. As an option, a fan could be integrated into (or along a path including) this space 63 above each flange 60, so that forced convection cooling could be facilitated. The ends 14 being generally above the ceiling tiles C (FIGS. 9 and 10), cause heat from operation of the LED modules 62 to remain above the ceiling tiles and away from air-conditioned space beneath the ceiling tiles C.

While the pair of flanges 60 are shown with the channel 76 therebetween which supports an upper portion of a central cross-tee 80, as an alternative, the flanges 60 could be generally horizontal and a single LED module (or more than two) could be mounted thereon without the channel 76 and without the central cross-tee 80 being provided. A single LED module 62 or some other form of light source could be mounted upon such a flange or other structure within the housing without a central cross-tee 80, and emitting light down upon a single large diffuser 45 (FIGS. 2 and 10) as an alternative embodiment.

The central cross-tee 80 is preferably provided as a separate structure which connects to the housing, but could be provided as part of the extrusion 12 and fully integrated into the housing. In this embodiment, the central cross-tee 80 includes a head 82 which is sized to fit within the channel 76. This head 82 could have a friction fit within the channel 76 or could be held in place by adhesive or fasteners. A plate 84 extends down from the head 82 to lower legs 86. The plate 84 is generally a planar structure oriented within a vertical plane and along a central elongate vertical plane of the overall lighting element 10. Thus, the central cross-tee 80 is positioned to bisect the housing into two separate lateral halves, with the central cross-tee 80 generally at a midpoint between the lateral cross-tees 20 in this embodiment.

Figure 9:
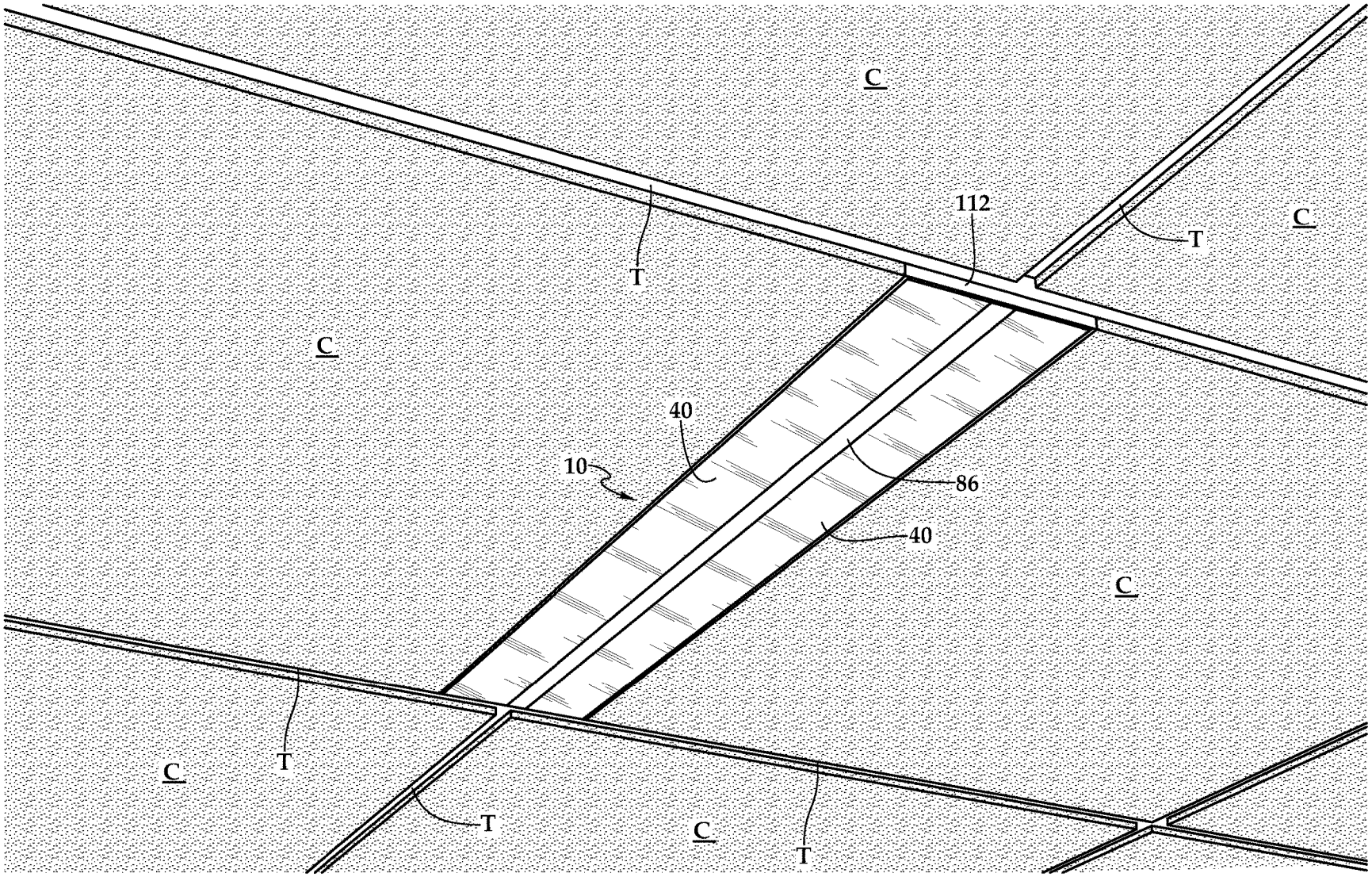
FIG. 9 is a perspective view from below of a suspended ceiling with the lighting element of the embodiment of FIG. 1 located therein and integrated with the adjacent T-bars and ceiling tiles of the suspended ceiling.
Figure 10:
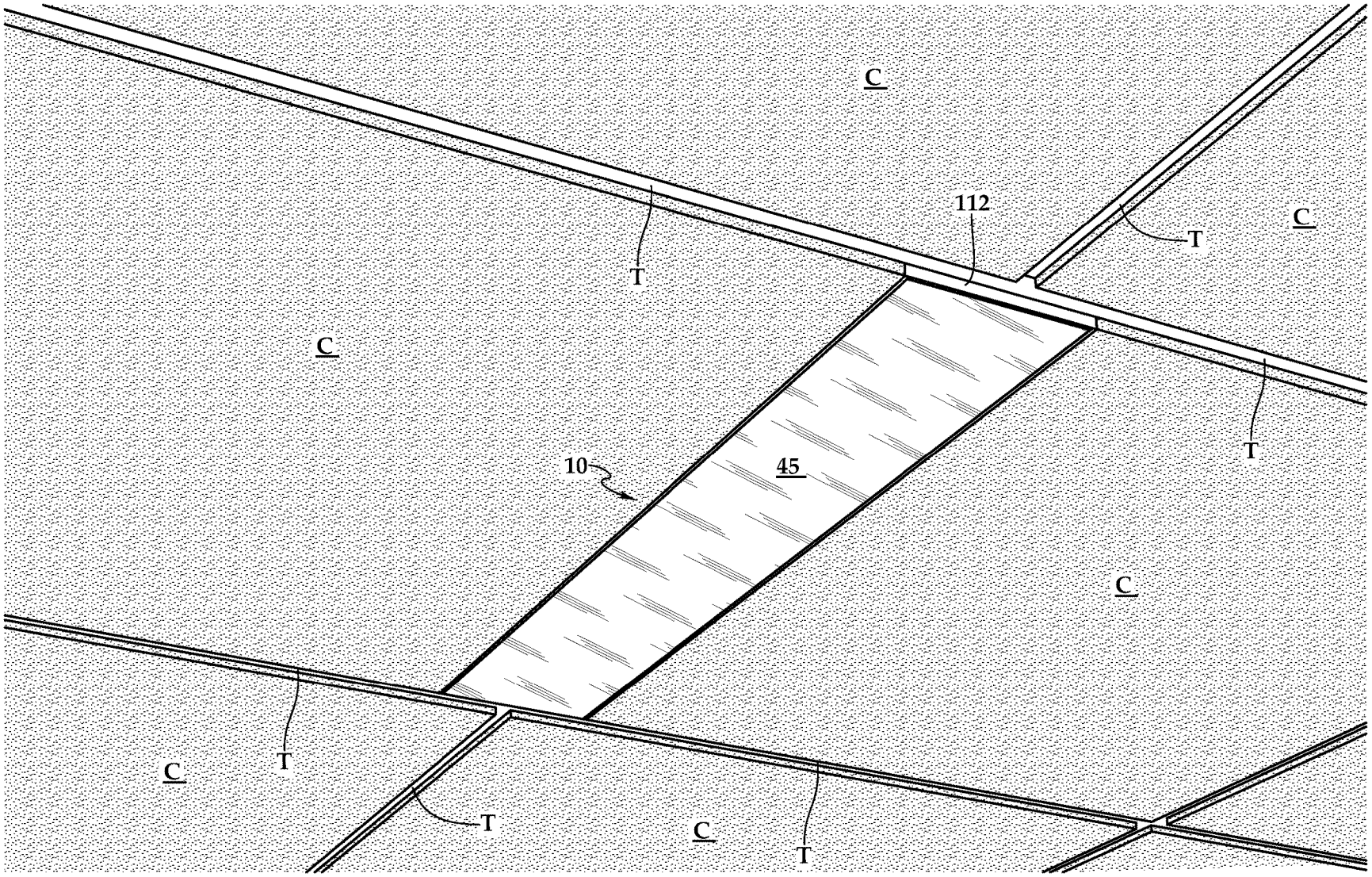
FIG. 10 is a perspective view from below of a suspended ceiling and illustrating an alternative configuration for the lighting element of FIG. 1 where a single diffuser is provided and the central cross-tees removed, in the configuration also depicted in FIG. 2.

The lower legs 86 extend horizontally away from the lower end of the plate 84. Outwardly facing gaps 88 at tips of the lower legs 86 hold inner edges 42 of the diffusers 40. Most preferably, an elevation of these outwardly facing gaps 88 matches an elevation of inwardly facing gaps 36 in each support foot 30 beneath each lateral cross-tee 20, so that the two diffusers 40 are parallel with each other and oriented horizontally spanning the two chambers 64 and lower openings 66 of the housing (FIG. 9). A recess 85 can be formed near each end of the central cross-tee 80 which can support the mounting of a tab 90 thereon. Such a tab 90 can attach to a slot of a T-bar T adjacent to one of the ends 14 of the lighting element 10.

Central upper portions of the housing of the lighting element 10 are defined by an upper portion 70 which joins the upper end 54 of each diagonal span 50 together. This upper portion 70 can include a spine extending vertically upward and with heat transfer fins 72 extending horizontally from either side of such a spine. A screw support slot 74 similar to the screw support slots 55 in the diagonal spans 50 can be provided at an upper portion of this spine in the upper portion 70, so that screws 75 (FIGS. 4 and 6) can hold an end cap 110 and cover 112 over each end 14 of the lighting element 10.

Figure 11:
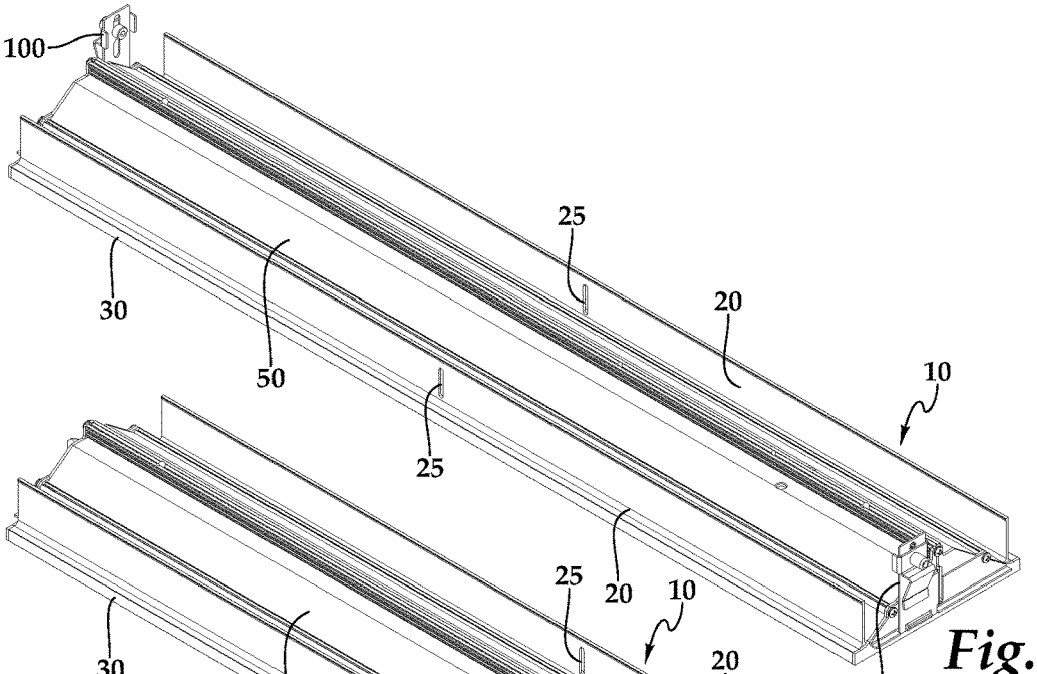
FIG. 11 is a perspective view of the lighting element of FIG. 1, further including clips at ends thereof similar to the clips shown in FIG. 5.
Figure 12:
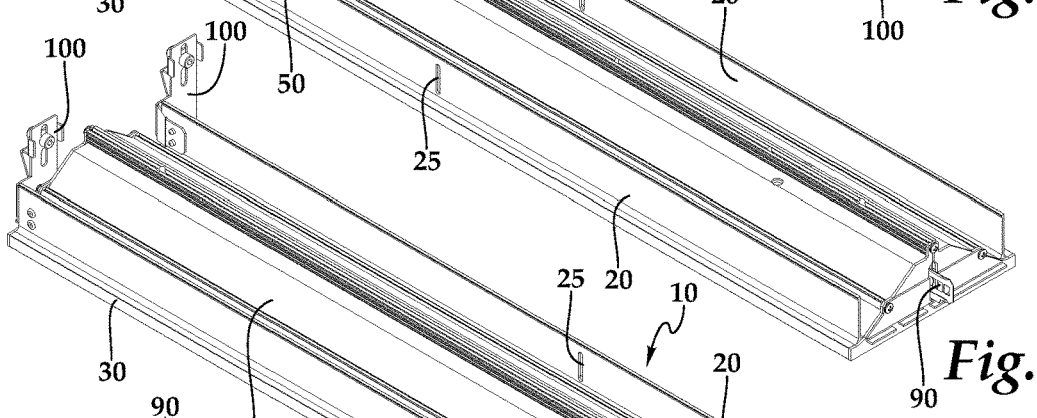
FIG. 12 is a perspective view similar to that which is shown in FIG. 11, except that a centrally located tab is provided at each end of the lighting element for attachment to adjacent T-bars, rather than the clips.
Figure 13:
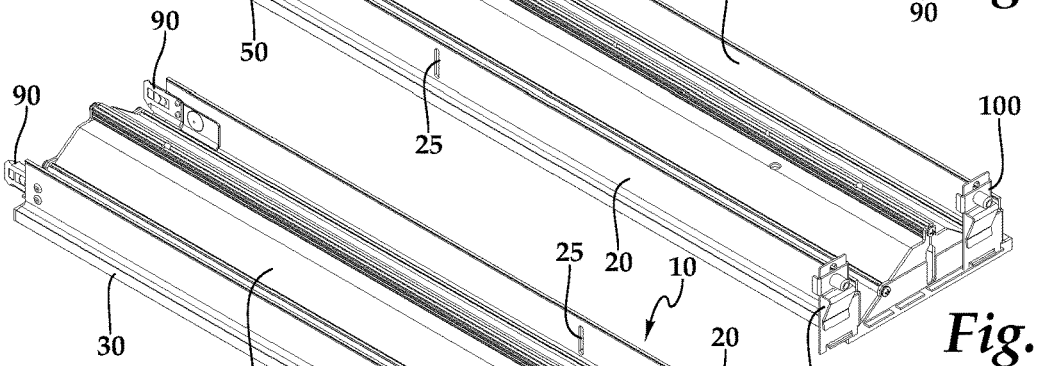
FIG. 13 is a perspective view similar to that which is shown in FIG. 11, but with a pair of clips at each end of the lighting element for attachment of the lighting element to T-bars and other structures within an overall suspended ceiling.

With reference to FIGS. 11-14, various different fasteners for ends 14 of the lighting element 10 are disclosed. In FIG. 11 a single clip 100 is provided at each end 14. In FIG. 12 a single tab 90 is provided at each end 14 of the lighting element 10. In FIG. 13 a pair of clips 100 are provided at each end 14 of the lighting element 10. These clips 100 are configured to attach over upper edges of spines S of T-bars T adjacent to the ends 14.

Figure 14:
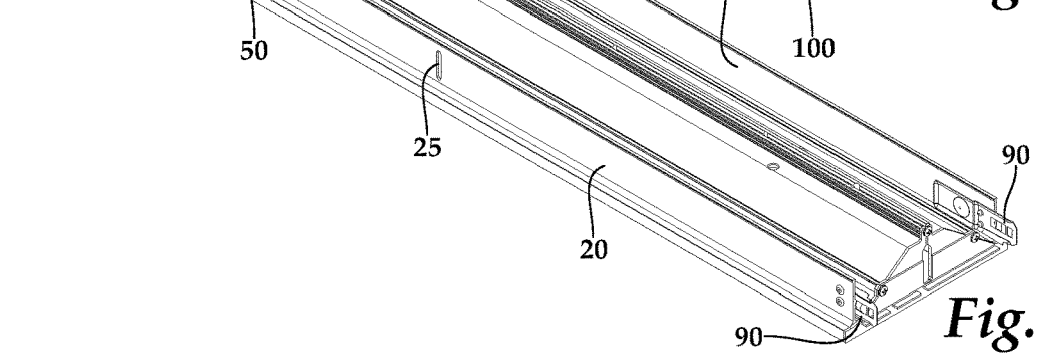
FIG. 14 is a perspective view similar to that which is shown in FIG. 11, except with two tabs at each end of the lighting element acting as fasteners for attachment to T-bars or other structures within a suspended ceiling.

In FIG. 14 a pair of tabs 90 are provided at each end 14. In such a configuration, additional slots might need to be formed in T-bars T, and particularly within spines S thereof with a space in between such slots matching a space in between such a pairs of tabs 90 at each end 14 of the lighting element 10. Further alternatives can also be provided, such as including a combination of tabs 90 and clips 100, or other numbers of tabs 90 or other numbers of clips 100, or utilizing other forms of fasteners for holding of ends 14 of the lighting element 10 to adjacent structures within the suspended ceiling. It is also conceivable that ends 14 of the lighting element 10 would not be connected to any other structures associated with the suspended ceiling. The lighting element 10 could either be carried through the slots 25 in the lateral cross-tees 20, or suspended from elevated structures above the suspended ceiling, such as through suspension wires extending down for the lighting element 10 and connecting to the lighting element 10. Such suspension wires could attach to the upper portion 70 or to the screw support slots 55 of the diagonal spans 50, or to tips 22 or other portions of the lateral cross-tees 20.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A suspended ceiling light, comprising in combination:

an elongate light support structure extending between opposite ends and carrying at least two electric lights on opposite sides of an elongate central plane extending between said ends;

said ends each attachable at least indirectly to T-bars within a grid of T-bars;

said elongate support structure including a pair of spines, one of said pair of spines on a first side of said elongate central plane and one of said pair of spines located on a second side of said elongate central plane, said first side opposite said second side; and said spines each including at least one slot therein, said slots spaced from said ends of said elongate support structure, said slots adapted to support ends of T-bars therethrough.

2. The light of claim 1 wherein said spines are oriented within substantially vertical planes.

3. The light of claim 1 wherein a central cross-tee including a central plate is oriented along said elongate central plane at a midpoint between said spines.

4. The light of claim 3 wherein said central cross-tee supports a diffuser on either side of said central cross-tee, each said diffuser located below one of said at least two electric lights.

5. The light of claim 1 wherein said spines include shelves at lower portions thereof which extend horizontally away from said central plane, said shelves adapted to support ceiling tile edges thereon.

6. The light of claim 3 wherein a diagonal span joins each of said spines to said central cross-tee, said diagonal spans each being higher adjacent to said central cross-tee than where said diagonal spans are adjacent to said spines.

7. The light of claim 6 wherein a flange extends between each of said diagonal spans and said plate of said central cross-tee, said flanges each carrying at least one of said at least two electric lights thereon, and shining down between said central cross-tee and one of said spines.

8. The light of claim 7 wherein said central cross-tee supports a diffuser on either side of said central cross-tee, each said diffuser located below one of said at least two electric lights.

9. The light of claim 1 wherein at least one of said ends of said elongate support structure includes a clip for attaching into a slot in a T-bar.

10. The light of claim 1 wherein at least one of said ends of said elongate support structure includes a fastener for coupling to a T-bar.

11. The light of claim 1 wherein said elongate support structure has a constant cross-sectional form between said ends.

12. The light of claim 11 wherein said elongate support structure has an extruded form.

13. The light of claim 12 wherein end caps attach to said ends and cover at least portions of said ends of said elongate support structure.

14. A light for a suspended ceiling, the light comprising a combination:

a housing having an interior chamber with at least one light source located within said chamber;

at least one lower opening at a lower portion of said housing, said lower opening open for light to radiate downward through said lower opening from said chamber, the light originating from said light source;

said housing having an elongate form with lateral sides longer than ends thereof;

each of said lateral sides including a slot sized and oriented to receive a fastener extending from an end of an elongate T-bar, such that T-bars can be connected to said housing through said slots;

wherein said light source includes LEDs along an elongate LED module; and wherein two LED modules are provided within said interior chamber of said housing, one of said two LED modules located on either side of an elongated vertical central plane midway between said lateral sides of said housing.

15. The light of claim 14 wherein at least one diffuser is located below said chamber of said housing and at least partially closing off said lower opening, said diffuser configured to transmit light therethrough.

16. The light of claim 14 wherein said slots are located at a midpoint between said ends.

* * * * *